US011511243B2

(12) United States Patent
Tamura

(10) Patent No.: US 11,511,243 B2
(45) Date of Patent: Nov. 29, 2022

(54) METHOD FOR MIXING A PLURALITY OF SOLUTIONS

(71) Applicant: Minoru Tamura, Anan (JP)

(72) Inventor: Minoru Tamura, Anan (JP)

( * ) Notice: Subject to any disclaimer, the term of this patent is extended or adjusted under 35 U.S.C. 154(b) by 622 days.

(21) Appl. No.: 16/346,666

(22) PCT Filed: Nov. 2, 2017

(86) PCT No.: PCT/JP2017/039766

§ 371 (c)(1),
(2) Date: May 1, 2019

(87) PCT Pub. No.: WO2018/084254

PCT Pub. Date: May 11, 2018

(65) Prior Publication Data

US 2020/0061551 A1 Feb. 27, 2020

(30) Foreign Application Priority Data

Nov. 2, 2016 (JP) ..... JP2016-215199

(51) Int. Cl.

| | |
|---|---|
| ***B01F 23/00*** | (2022.01) |
| ***B01F 23/40*** | (2022.01) |
| ***B01F 23/45*** | (2022.01) |
| ***B01F 25/10*** | (2022.01) |
| ***B01F 25/312*** | (2022.01) |
| ***B01F 33/81*** | (2022.01) |
| ***B01F 33/82*** | (2022.01) |

(52) U.S. Cl.

CPC ..... *B01F 23/49* (2022.01); *B01F 23/45* (2022.01); *B01F 25/102* (2022.01); *B01F 25/3121* (2022.01); *B01F 25/31232* (2022.01); *B01F 33/811* (2022.01); *B01F 33/821* (2022.01); *B01F 23/483* (2022.01)

(58) Field of Classification Search

CPC ..... B01F 2003/0896; B01F 5/0062; B01F 5/0415; B01F 25/102; B01F 23/483

See application file for complete search history.

(56) References Cited

U.S. PATENT DOCUMENTS 1,690,849 A * 11/1928 Barrymore ..... B28C 7/122 366/40
5,171,405 A 12/1992 Torregrossa
6,481,883 B1 * 11/2002 Ellen ..... B28C 5/04 366/18

(Continued)

FOREIGN PATENT DOCUMENTS

CN 201676663 12/2010
CN 103657963 3/2014

(Continued)

OTHER PUBLICATIONS

International Search Report dated Feb. 6, 2018 in International (PCT) Application No. PCT/JP2017/039766.

*Primary Examiner* — Anshu Bhatia
(74) *Attorney, Agent, or Firm* — Wenderoth, Lind & Ponack, L.L.P.

(57) ABSTRACT

A first solution is mixed and diluted with diluting liquid to make a first dilute solution, a second solution is mixed and diluted with diluting liquid to make a second dilute solution, and the first dilute solution and second dilute solution, both diluted with diluting liquid, are mixed in a sealed tank.

7 Claims, 3 Drawing Sheets

(56) References Cited

U.S. PATENT DOCUMENTS

| | | | | |
|---|---|---|---|---|
| 7,464,757 | B2 * | 12/2008 | Pessin | B01F 33/812 366/14 |
| 2006/0164914 | A1 | 7/2006 | Goto et al. | |
| 2006/0243646 | A1 | 11/2006 | Kucher et al. | |
| 2009/0201760 | A1 * | 8/2009 | Vorage | B01F 25/104 366/163.1 |
| 2011/0199855 | A1 | 8/2011 | Hanada | |

FOREIGN PATENT DOCUMENTS

| | | |
|---|---|---|
| JP | 50-35756 | 4/1975 |
| JP | 56-39121 | 4/1981 |
| JP | 4-247291 | 9/1992 |
| JP | 6-191840 | 7/1994 |
| JP | 7-185308 | 7/1995 |
| JP | 2008-513625 | 5/2008 |
| JP | 2008-539339 | 11/2008 |
| JP | 3168124 | 6/2011 |
| JP | 2015-43748 | 3/2015 |
| WO | 2004/076042 | 9/2004 |
| WO | 2006/032427 | 3/2006 |
| WO | 2010/047167 | 4/2010 |

* cited by examiner

METHOD FOR MIXING A PLURALITY OF SOLUTIONS

CROSS-REFERENCE TO RELATED APPLICATION

The present application claims priority under 35 U. S. C. § 119 to Japanese Patent Application No. 2016-215199, filed on Nov. 2, 2016, the content of which is hereby incorporated by reference in their entirety.

BACKGROUND OF THE INVENTION

1. Field of the Invention

The present invention relates to a method of mixing and diluting a plurality of solutions, and in particular relates to a mixing method optimal for mixing highly concentrated solutions that react when mixed.

2. Description of the Related Art

Mixing methods are employed in a variety of applications. For example, mixing methods that dilute antibacterial agents and/or a plurality of fertilizers with water are employed in agricultural applications. As shown in FIG. 4, in the most straightforward of mixing methods, an apparatus is used that simply adds solutions at sequential points along a duct with water flowing inside. This mixing method can mix and dilute a plurality of solutions that do not chemically react. However, when this mixing method is used to mix and dilute solutions that react with each other when mixed in high concentrations, the reacting mixture can result in a variety of detrimental effects. For example, when a solution such as sulfuric acid is mixed with the antibacterial agent sodium hypochlorite to adjust its pH value, the pH at the point where sulfuric acid is added becomes extremely low, and this has the adverse effect that the sodium hypochlorite generates toxic chlorine gas. When sodium hypochlorite used as an antibacterial agent has its pH adjusted to approximately 4 by sulfuric acid addition, the constituent percentage of extremely long-life stable HClO with exceptional antibacterial properties can be close to 100%. Conversely, when sodium hypochlorite pH drops to 3 or below due to local introduction of sulfuric acid, it has the adverse result that 70% or more becomes toxic chlorine gas.

Detrimental results are not limited to sodium hypochlorite solutions. For example, methods that mix a plurality of high concentration fertilizer solutions can also adversely result in supersaturated conditions and effects such as crystallization.

Turning to FIG. 5, an improved mixing method is illustrated (refer to WO2010/047167). This mixing method dilutes one of the solutions (solution A) to make a dilute solution, and mixes another solution (solution B) with that dilute solution.

The mixing method shown in FIG. 5 can reduce adverse effects associated with the mixing method of FIG. 4. However, while one of the solutions (solution A) in FIG. 5 is diluted, a second solution (solution B) is not diluted and is mixed as-is or in high concentration. Consequently, detrimental effects produced at the mixing point C due to addition of high concentration solution B cannot be eliminated.

It is one object of the present invention to eliminate the various adverse effects due to mixing high concentration solutions, and to present a method of mixing a plurality of solutions that can mix and dilute a variety of solutions under ideal conditions.

SUMMARY OF THE INVENTION

The mixing apparatus of the present invention mixes and dilutes a plurality of solutions with diluting liquid. The mixing apparatus is provided with a first diluter 1A to mix a first solution with diluting liquid to make a first dilute solution, a second diluter 1B to mix a second solution with diluting liquid to make a second dilute solution, and a sealed tank 2 to mix the first dilute solution discharged from the first diluter 1A with the second dilute solution discharged from the second diluter 1B.

The apparatus for mixing a plurality of solutions described above adds diluting liquid to dilute the first solution, adds diluting liquid to dilute the second solution, and introduces the first dilute solution and the second dilute solution into the sealed tank 2 for mixing. This mixing apparatus does not add high concentration solutions in sequence to a diluting liquid as in related art apparatus, nor does it dilute the first solution by adding diluting liquid and subsequently add the second solution to that diluted first solution to mix first and second solutions. Rather, the first solution and the second solution are both diluted via diluting liquid, and those diluted solutions flow into the sealed tank 2 for mixing. Both the first and second solutions are mixed in a diluted state; neither one of the solutions is mixed in highly concentrated condition. Accordingly, the mixing apparatus described above has the characteristic that neither solution is mixed in a highly concentrated state, various adverse effects due to mixing highly concentrated solutions are eliminated, and as a result, a plurality of solutions can be mixed and diluted under ideal conditions. The mixing apparatus described above can be used extremely effectively in applications such as mixing an acid, for example hydrochloric acid for pH adjustment, with an aqueous solution of sodium hypochlorite to produce antibacterial solution having a pH adjusted to approximately 4 and a high HOCl content. Accordingly, antibacterial solution primarily composed of the effective antibacterial agent HOCl can be produced without generating toxic chlorine gas due to locally low pH at mixing points and without loss of active ingredient as a result of conversion to chlorine gas. Further, when used to mix solutions such as fertilizers that aggregate (clump) when mixed in the highly concentrated state, the mixing apparatus has the characteristic that clumping at the mixing point can be prevented and a nutrient solution can be produced that contains effective fertilizer components.

In the mixing apparatus of the present invention, the sealed tank 2 can be a cyclone (vortex) mixing tank, and the cyclone mixing tank can be configured with the first dilute solution inlet duct 3A and the second dilute solution inlet duct 3B connected in tangential directions with respect to the cyclone mixing tank. Because the sealed tank 2 is a cyclone mixing tank, this mixing apparatus has the characteristic that the dilute solutions rotate inside the cyclone mixing tank and can be more uniformly mixed while rotating.

In the mixing apparatus of the present invention, the cyclone mixing tank, which is the sealed tank 2, can have the form of a circular cylinder that extends in the vertical direction, a mixed solution discharge duct 4 can be disposed at the center of the circular cylinder, and the inlet for the flow of mixed solution into the discharge duct 4 can be disposed at a location distanced from the top of the cyclone mixing tank.

The mixing apparatus described above has the characteristic that a plurality of solutions can be uniformly mixed within, and discharged from the cyclone mixing tank. This is because solutions mix while rotating within the cyclone mixing tank and flow towards the center of the tank where they are discharged.

In the mixing apparatus of the present invention, an air vent valve 5 can be connected at the upper region of the cyclone mixing tank, which is the sealed tank 2. Since gas build-up inside the cyclone mixing tank can be discharged to the outside via the air vent valve 5, solutions that generate gas during mixing can be efficiently and uniformly mixed. This is because cyclone mixing tank effective volume reduction due to gas evolution can be prevented.

In the mixing apparatus of the present invention, the first diluter 1A and the second diluter 1B can be cyclone mixing tanks, further, the first diluter 1A and the second diluter 1B can be ejector pumps (venturi pumps) as well.

The method for mixing a plurality of solutions of the present invention is provided with dilution process steps that include a step to mix a first solution with diluting liquid to make a first dilute solution and a step to mix a second solution with diluting liquid to make a second dilute solution, and a mixing process step that introduces the first dilute solution and the second dilute solution diluted in the dilution process steps into a sealed tank 2 to mix the first solution and second solution.

The method for mixing a plurality of solutions described above adds diluting liquid to dilute the first solution, adds diluting liquid to dilute the second solution, and introduces the first dilute solution and the second dilute solution into the sealed tank 2 for mixing. This mixing method does not add high concentration solutions in sequence to a diluting liquid as in related art apparatus, nor does it dilute the first solution by adding diluting liquid and subsequently add the second solution to that diluted first solution to mix first and second solutions. Rather, the first solution and the second solution are both diluted via diluting liquid, and those diluted solutions flow into the sealed tank 2 for mixing. Both the first and second solutions are mixed in a diluted state; hence neither one of the solutions is mixed in highly concentrated condition. Accordingly, the mixing method described above has the characteristic that neither solution is mixed in a highly concentrated state, various adverse effects due to mixing highly concentrated solutions are eliminated, and as a result, a plurality of solutions can be mixed and diluted under ideal conditions.

DESCRIPTION OF THE EMBODIMENTS

The following describes embodiments of the present invention based on the figures. However, the following embodiments are merely specific examples of the mixing apparatus and method for mixing a plurality of solutions representative of the technology associated with the present invention, and the mixing apparatus and method for mixing a plurality of solutions of the present invention are not limited to the embodiments described below.

Further, in this application, alphanumeric labels (reference signs) are assigned to components of the embodiments to make the patent claims more easily understood, and those labels are appended to components described in the "Claims" and "Means for Solving the Problem and Effects of the Invention" sections. However, components described in the patent claims are in no way limited to the components of the embodiments.

Figure 1:
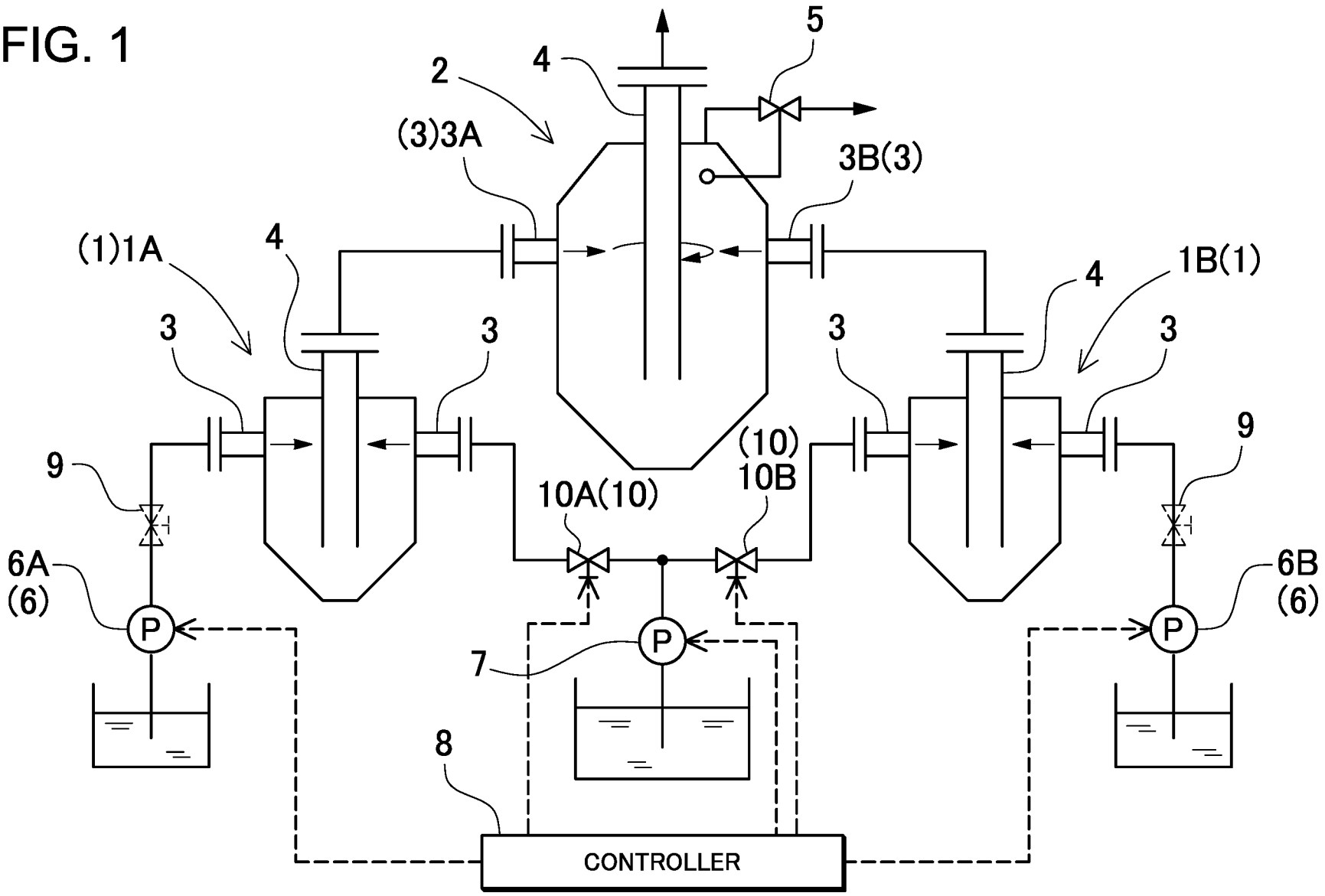
FIG. 1 is a block diagram of the mixing apparatus for an embodiment of the present invention.
Figure 2:
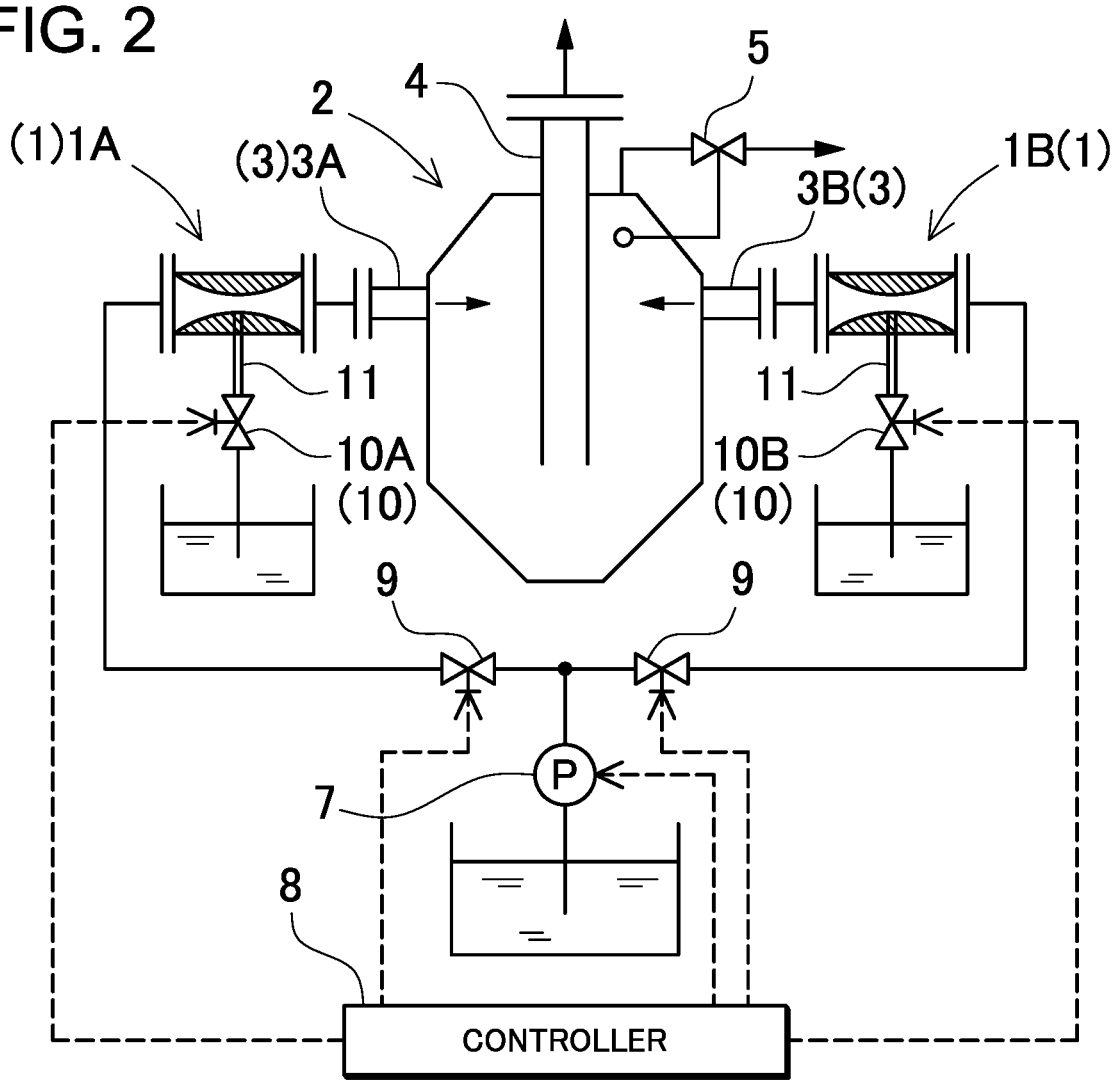
FIG. 2 is a block diagram of the mixing apparatus for another embodiment of the present invention.

The mixing apparatus shown in FIGS. 1 and 2 is provided with a first diluter 1A that mixes the first solution with diluting liquid to make a first dilute solution, a second diluter 1B that mixes the second solution with diluting liquid to make a second dilute solution, a sealed tank 2 that mixes the first dilute solution discharged from the first diluter 1A with the second dilute solution discharged from the second diluter 1B, solution pumps 6 that supply first and second solutions to the first and second diluters 1A, 1B, a diluting liquid pump 7 that supplies diluting liquid to the first and second diluters 1A, 1B and the sealed tank 2, and a controller 8 to control the flow (rates) of the solutions and diluting liquid.

Since the mixing apparatus shown in the figures is equipped with pumps to supply the solutions and diluting liquid, flow rates of the solution pumps 6 and diluting liquid pump 7 are controlled to adjust the flow (rates) of the solutions and diluting liquid. However, in a mixing apparatus where the solutions and diluting liquid are supplied under pressure from external equipment, the solution pumps and diluting liquid pump are superfluous, and flow (rates) of the solutions and diluting liquid are adjusted by regulating valves.

In the mixing apparatus shown in FIG. 1, the first and second diluters 1A, 1B are cyclone (vortex) mixing tanks. As shown in the horizontal cross-section of FIG. 3, a cyclone mixing tank has a pair of inlet ducts 3 disposed at opposing locations and a discharge duct 4 disposed with vertical orientation at the center of the circular cylindrical tank. In a diluter 1 that is a cyclone mixing tank, solution is supplied from a solution pump 6 to the inlet duct 3 on one side, diluting liquid is supplied from the diluting liquid pump 7 to the inlet duct 3 on the opposite side, and the solution and diluting liquid are mixed inside the tank (for delivery to the sealed tank 2). The pair of inlet ducts 3 is connected to the circular cylinder in tangential directions such that the inflow of solution and diluting liquid rotates inside the circular cylindrical tank for mixing and dilution. Solution supplied to the diluting liquid rotates inside the circular cylindrical tank and is supplied to the sealed tank 2 through the discharge duct 4.

Each cyclone mixing tank diluter 1 shown in FIG. 1 has the inlet ducts 3 connected to the upper part of the circular cylinder and the bottom end of the discharge duct 4 disposed in the lower part of the circular cylinder. In this cyclone mixing tank, solution and diluting liquid flow into the tank from the inlet ducts 3, flow inside the tank towards the bottom of the circular cylinder while rotating in a vortex, and are discharged through the bottom end of the discharge duct 4. A cyclone mixing tank with this configuration rotates solution and diluting liquid inside the circular cylinder via a vortex, which extends the flow path to allow more uniform mixing and dilution for discharge through the discharge duct 4.

The cyclone mixing tank of the first diluter 1A introduces first solution and diluting liquid through the pair of inlet ducts 3, mixes and dilutes the first solution with diluting liquid inside the circular cylindrical tank, and supplies that mixture as first dilute solution to the sealed tank 2 via the discharge duct 4. Similarly, the second diluter 1B introduces second solution and diluting liquid through the pair of inlet ducts 3, mixes and dilutes the second solution with diluting liquid inside the circular cylindrical tank, and supplies that mixture as second dilute solution to the sealed tank 2 via the discharge duct 4.

Figure 3:
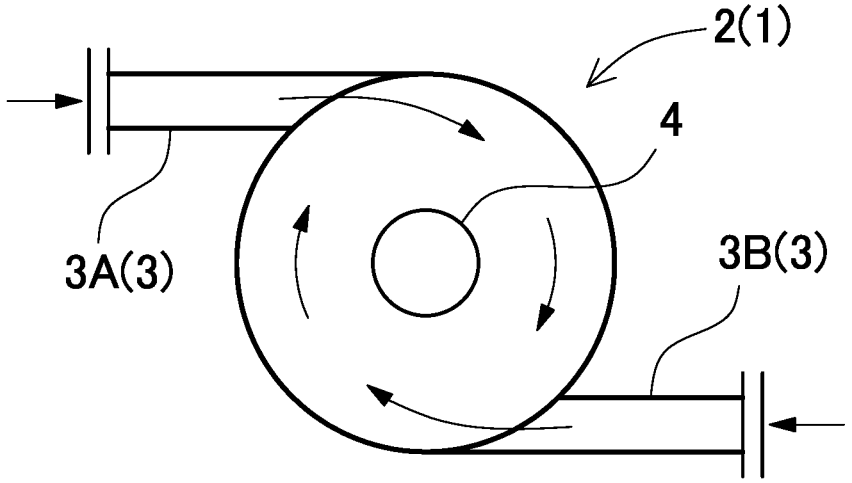
FIG. 3 is a cross-section diagram horizontally through a cyclone (vortex) mixing tank, which serves as the diluters and sealed tank of the mixing apparatus shown in FIG. 1.
Figure 4:
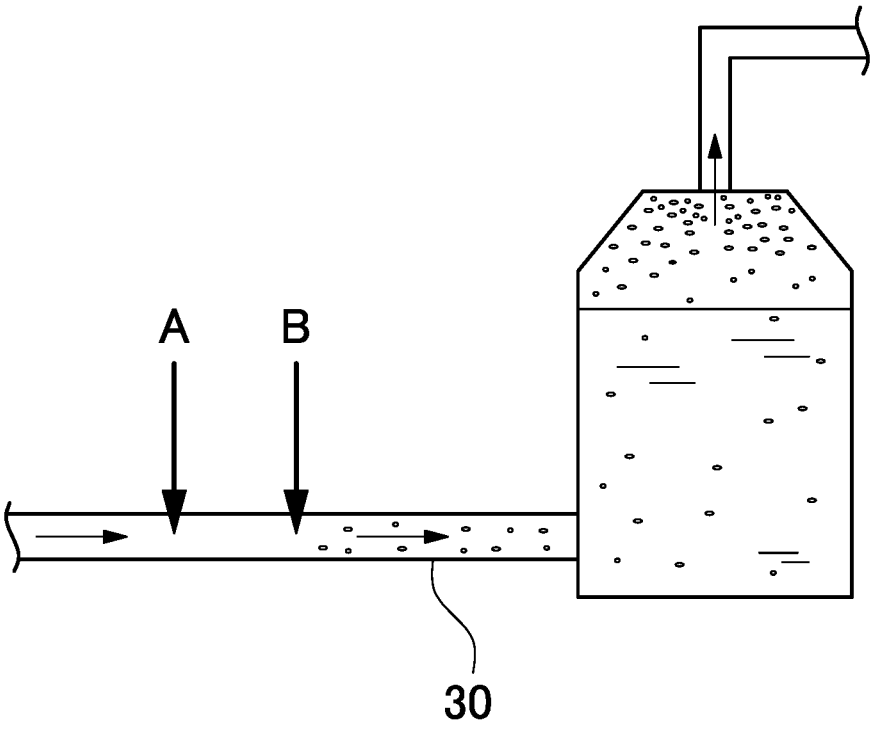
FIG. 4 RELATED ART
FIG. 4 is a block diagram showing one example of a related art mixing apparatus.
Figure 5:
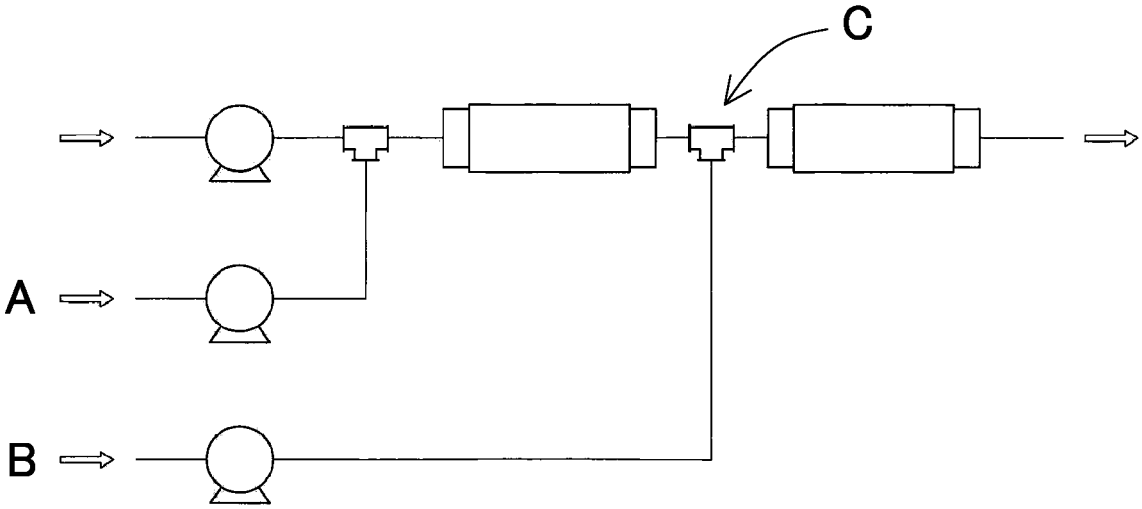
FIG. 5 RELATED ART
FIG. 5 is a block diagram showing another example of a related art mixing apparatus.

The sealed tank 2 for mixing the first dilute solution and the second dilute solution is also a cyclone (vortex) mixing tank, and as shown in FIG. 3, it also has a pair of inlet ducts 3 disposed at opposing locations and a discharge duct 4 disposed with vertical orientation at the center of the circular cylindrical tank. In the cyclone mixing tank that serves as the sealed tank 2, first dilute solution discharged from the first diluter 1A is supplied from the inlet duct 3A on one side, second dilute solution discharged from the second diluter 1B is supplied from the inlet duct 3B on the other side, and the first dilute solution and second dilute solution are mixed inside the circular cylindrical tank and discharged outside the tank. In this cyclone mixing tank, which is the sealed tank 2, the pair of inlet ducts 3 is also connected in directions tangential to the circular cylinder, and first dilute solution and second dilute solution flowing into the tank rotate in a vortex for mixing and dilution inside the circular cylindrical tank. First and second dilute solutions are mixed while rotating inside the circular cylindrical tank and discharged to the outside through the discharge duct 4.

The mixing apparatus in FIGS. 1 and 2 has an air vent valve 5 connected at the upper region of the cyclone mixing tank, which is the sealed tank 2. A valve that senses the height of the surface of liquid in the sealed tank 2 opens when the surface level drops below a set level and closes when the surface level rises to a highest level, or a valve that opens for gas flow and closes for liquid flow can be used as the air vent valve 5. When gas accumulates in the upper part of the sealed tank 2, the air vent valve 5 opens to discharge the gas, and that causes the liquid surface level to rise. Accordingly, a sealed tank 2 with an air vent valve 5 can consistently maintain the liquid level at the top of the cyclone mixing tank and effectively maintain a large tank volume. This has the characteristic that the dilute solutions flowing into the tank can be consistently mixed in a uniform manner.

The mixing apparatus mixes the first solution and second solution according to a specified mixing ratio, and mixes each solution and diluting liquid in a specified ratio to dilute the solutions in specified ratios. The first solution and second solution mixing ratio is determined by the ratio of the amount of first solution flowing into the first diluter 1A to the amount of second solution flowing into the second diluter 1B. Since the two solution pumps 6 supply solution to the first diluter 1A and the second diluter 1B in the mixing apparatus of FIG. 1, the mixing ratio of the first solution and second solution is set and adjusted by the ratio of the flow rates from the first solution pump 6A connected to the first diluter 1A and from the second solution pump 6B connected to the second diluter 1B. Accordingly, to set the solution mixing ratio, the controller 8 controls the flow rates of the first solution pump 6A and second solution pump 6B. However, in the mixing apparatus of FIG. 1, regulating valves 9 (shown by broken lines in FIG. 1) are installed at the output sides of the first solution pump 6A and second solution pump 6B, and the controller 8 can also adjust the first and second solution mixing ratio by adjusting the degree of regulating valve 9 opening.

In addition, a first flow rate regulating valve 10A connected in line with an inlet duct 3 of the first diluter 1A regulates the flow of diluting liquid supplied to the first diluter 1A, and a second flow rate regulating valve 10B connected in line with an inlet duct 3 of the second diluter 1B regulates the flow of diluting liquid supplied to the second diluter 1B. This sets the ratio for diluting first solution with diluting liquid and the ratio for diluting second solution with diluting liquid. The first flow rate regulating valve 10A is controlled by the controller 8 to regulate the flow rate of diluting liquid corresponding to the flow rate of first solution into the first diluter 1A and thereby dilute the first solution in a specified ratio. Similarly, the second flow rate regulating valve 10B is controlled by the controller 8 to regulate the flow rate of diluting liquid corresponding to the flow rate of second solution into the second diluter 1B and thereby dilute the second solution in a specified ratio.

Further, the diluting liquid flow rate regulating valves 10 also set the ratio of diluting liquid to the first solution added to the second solution. Specifically, the flow rate regulating valves 10 set the ratio for diluting the entire amount of solution. The controller 8 controls diluting liquid flow rates with the first flow rate regulating valve 10A and the second flow rate regulating valve 10B to set (to specific values) the dilution ratio of the first solution with diluting liquid, the dilution ratio of the second solution with diluting liquid, and cumulative dilution ratio of all solutions with diluting liquid.

Turning to FIG. 2, a mixing apparatus is shown that has ejector pumps (venturi pumps) as the first and second diluters 1A, 1B. Each ejector pump has a suction duct 11 connected to a narrowed section in the diluting liquid flow path where flow velocity is increased producing a negative pressure region (venturi effect). Each ejector pump, which is a diluter, introduces solution by suction into the high velocity region of the diluting liquid flow to mix and dilute the solution with diluting liquid. Each solution, which is mixed and diluted with diluting liquid, is supplied to the sealed tank 2.

First solution is sucked into the ejector pump of the first diluter 1A, mixed and diluted with the diluting liquid, and supplied to the sealed tank 2. Similarly, second solution is sucked into the ejector pump of the second diluter 1B, mixed and diluted with the diluting liquid, and also supplied to the sealed tank 2.

In the mixing apparatus shown in FIG. 2, a first flow rate regulating valve 10A is connected in the suction duct 11 of the first ejector pump serving as the first diluter 1A, and a second flow rate regulating valve 10B is connected in the suction duct 11 of the second ejector pump serving as the second diluter 1B. Further, a first regulating valve 9 is connected between the diluting liquid pump 7 and the first ejector pump, and a second regulating valve 9 is connected between the diluting liquid pump 7 and the second ejector pump. The first and second flow rate regulating valves 10A, 10B, the first and second regulating valves 9, and the diluting liquid pump 7 are controlled by the controller 8 to adjust to optimal values the mixing ratio of the first solution and second solution and the overall ratio of solution to diluting liquid. The controller 8 controls the ratio of solution flow rates with the first and second flow rate regulating valves 10A, 10B to set the mixing ratio of the first solution and second solution. In addition, the controller 8 controls the ratio of diluting liquid flow rates with the first and second regulating valves 9 and the diluting liquid pump 7 flow rate to adjust to an optimum value the overall ratio of solution to diluting liquid, which is the cumulative dilution ratio of all solutions. However, since the amount of solution supplied (sucked into) to an ejector pump varies with diluting liquid flow rate, diluting liquid flow rate is first adjusted, followed by fine adjustment of the flow rate regulating valves 10 to accurately set the mixing ratio of the first and second solutions.

The mixing apparatus of the present invention can be used effectively as an apparatus to mix solutions, which produce adverse effects when mixed in high concentration, under ideal conditions.

It should be apparent to those with an ordinary skill in the art that while various preferred embodiments of the invention have been shown and described, it is contemplated that the invention is not limited to the particular embodiments disclosed, which are deemed to be merely illustrative of the inventive concepts and should not be interpreted as limiting the scope of the invention, and which are suitable for all modifications and changes falling within the scope of the invention as defined in the appended claims.

The invention claimed is:

1. An apparatus for mixing a plurality of solutions that mixes and dilutes the plurality of solutions with diluting liquid, the apparatus comprising:

a first diluter for mixing a first solution with diluting liquid to prepare a first dilute solution;

a second diluter for mixing a second solution with diluting liquid to prepare a second dilute solution; and a sealed tank for mixing the first dilute solution discharged from the first diluter with the second dilute solution discharged from the second diluter, wherein the sealed tank is connected with a first dilute solution inlet duct and a second dilute solution inlet duct in tangential directions so that the first dilute solution from the first dilute solution duct and the second dilute solution from the second dilute solution duct flow in the same circular stream direction in the sealed tank, wherein the sealed tank is a cyclone mixing tank, and wherein the cyclone mixing tank is a circular cylinder extending in a vertical direction, with a mixed solution discharge duct disposed at a center of the circular cylinder, and wherein an inlet of the mixed solution discharge duct is disposed at a location distanced from a top of the cyclone mixing tank so that flow of the mixed solution is discharged upwardly therethrough.

2. The apparatus for mixing a plurality of solutions as cited in claim 1 wherein an air vent valve is connected at the upper region of the cyclone mixing tank, which is the sealed tank.

3. The apparatus for mixing a plurality of solutions as cited in claim 1 wherein the first diluter is a cyclone mixing tank.

4. The apparatus for mixing a plurality of solutions as cited in claim 1 wherein the second diluter is a cyclone mixing tank.

5. The apparatus for mixing a plurality of solutions as cited in claim 1 wherein the first diluter is an ejector pump.

6. The apparatus for mixing a plurality of solutions as cited in claim 1 wherein the second diluter is an ejector pump.

7. A method for mixing a plurality of solutions that mixes and dilutes the plurality of solutions with diluting liquid, the method comprising:

mixing a first solution with diluting liquid in a first diluter to prepare a first dilute solution while mixing a second solution with diluting liquid in a second diluter to prepare a second dilute solution; and introducing the first dilute solution and the second dilute solution into a sealed tank to mix the first solution and second solution, the sealed tank being connected with a first dilute solution inlet duct and a second dilute solution inlet duct in tangential directions so that the first dilute solution from the first dilute solution duct and the second dilute solution from the second dilute solution duct flow in the same circular stream direction in the sealed tank, wherein the sealed tank is a cyclone mixing tank, and wherein the cyclone mixing tank is a circular cylinder extending in a vertical direction, with a mixed solution discharge duct disposed at a center of the circular cylinder, and wherein an inlet of the mixed solution discharge duct is disposed at a location distanced from a top of the cyclone mixing tank so that the flow of the mixed solution is discharged upwardly therethrough.

* * * * *